US009387961B2

(12) United States Patent
Mithal

(10) Patent No.: US 9,387,961 B2
(45) Date of Patent: Jul. 12, 2016

(54) SPLASH AND SPILL RESISTANT LID

(71) Applicant: Waddington North America, Inc., Chelmsford, MA (US)

(72) Inventor: Ashish K Mithal, Chelmsford, MA (US)

(73) Assignee: Waddington North America, Inc., Chelmsford, MA (US)

( * ) Notice: Subject to any disclaimer, the term of this patent is extended or adjusted under 35 U.S.C. 154(b) by 0 days.

(21) Appl. No.: 14/245,116

(22) Filed: Apr. 4, 2014

(65) Prior Publication Data

US 2014/0299614 A1 Oct. 9, 2014

Related U.S. Application Data

(60) Provisional application No. 61/808,653, filed on Apr. 5, 2013.

(51) Int. Cl.
*A47G 19/22* (2006.01)
*B65D 43/02* (2006.01)

(52) U.S. Cl.
CPC ..... *B65D 43/0212* (2013.01); *A47G 19/2272* (2013.01); *B65D 2543/00046* (2013.01); *B65D 2543/0074* (2013.01); *B65D 2543/00092* (2013.01); *B65D 2543/00296* (2013.01); *B65D 2543/00518* (2013.01)

(58) Field of Classification Search
CPC ..... A47G 19/2272; B65D 2543/00046; B65D 43/0212; B65D 2543/00518; B65D 2543/0074; B65D 2543/00092; B65D 2543/00296
USPC ..... 220/367.1, 711, 713, 717, 719; 229/404, 906.1
See application file for complete search history.

(56) References Cited

U.S. PATENT DOCUMENTS

| | | | |
|---|---|---|---|
| 236,266 | A | 1/1881 | Shirley |
| 622,564 | A | 4/1899 | Tebbetts |
| 1,034,636 | A | 8/1912 | McNair |

(Continued)

FOREIGN PATENT DOCUMENTS

| | | | |
|---|---|---|---|
| JP | 20100274965 | A | 12/2010 |
| JP | 2012176800 | A | 9/2012 |

OTHER PUBLICATIONS

Cardinal Glassware, Arcoroc, Cardinal International, 30 Corporate Drive, Wayne, NJ 07470 (6 pages) pp. 84 and 85 of Catalog.

(Continued)

*Primary Examiner* — James N Smalley
(74) *Attorney, Agent, or Firm* — Maine Cernota & Rardin

(57) ABSTRACT

A lid for a drinking cup enables drinking while inhibiting splashing and spilling. The lid features a dispensing well formed in a drinking spout. The dispensing well includes a plurality of openings in a sidewall proximate a spout front wall. All direct liquid paths out of the cup are substantially blocked. A plurality of baffles around the openings direct beverage flow in a plurality of channels before the beverage reaches the dispensing well. Beverage splashes larger than the channels are deflected or broken up, before passing through. The placement of the openings directs splashed liquid away from the user. A plurality of vent holes is provided to allow air to enter the cup as beverage is consumed. Vent holes located near the dispensing well can be blocked during drinking when the cup is full and the beverage is hot, but unblocked as the beverage cools and is consumed.

19 Claims, 7 Drawing Sheets

(56) References Cited

U.S. PATENT DOCUMENTS

D43,852 S 4/1913 Sanford
D52,727 S 12/1918 Beiswanger
1,441,010 A 1/1923 McGuire
D69,040 S 12/1925 Loomis
D69,929 S 4/1926 Zimmerman
1,629,358 A 5/1927 Padgett
D99,555 S 5/1936 Smith
D124,290 S 12/1940 Chaplin
2,259,856 A 10/1941 Moore
D164,407 S 9/1951 Cowan
D174,832 S 5/1955 Nowak
3,047,179 A 7/1962 Madej
D195,699 S 7/1963 Bostrom
3,101,857 A 8/1963 Freedman
3,546,752 A 12/1970 Sargent
3,589,551 A 6/1971 Haggbom
3,688,942 A 9/1972 Mitchell et al.
3,693,847 A 9/1972 Gibson
3,707,240 A 12/1972 Wilson
3,889,842 A 6/1975 Bennett
4,049,187 A 9/1977 Florian
4,190,173 A 2/1980 Mason
4,241,855 A 12/1980 Yoshioka
4,322,014 A 3/1982 Philip
4,331,255 A 5/1982 Fournier
4,494,672 A 1/1985 Pearson
4,503,992 A 3/1985 Sitko et al.
4,589,569 A * 5/1986 Clements ..... 220/380
4,615,459 A 10/1986 Clements
4,619,372 A 10/1986 McFarland
4,620,665 A 11/1986 McSherry
D287,207 S 12/1986 Daenen et al.
4,684,024 A 8/1987 Ebrahim et al.
4,687,117 A 8/1987 Terauds
4,721,210 A 1/1988 Lawrence et al.
4,753,365 A 6/1988 Seppala
4,782,975 A 11/1988 Coy
4,805,797 A 2/1989 Natori
4,874,083 A 10/1989 Antoni et al.
4,899,902 A 2/1990 Demars
4,949,880 A 8/1990 Bradley
4,986,438 A 1/1991 Borst
5,050,758 A 9/1991 Freeman et al.
5,054,640 A 10/1991 Tucker
5,076,333 A 12/1991 Law
5,125,525 A 6/1992 Tucker
5,143,248 A 9/1992 Sawatsky
5,203,467 A 4/1993 Tucker
5,203,490 A 4/1993 Roe
5,205,473 A 4/1993 Coffin, Sr.
5,222,656 A 6/1993 Carlson
5,240,132 A 8/1993 Tucker
5,253,780 A 10/1993 Adado
5,253,781 A 10/1993 Van Melle et al.
D344,210 S 2/1994 Cousisn et al.
D345,912 S 4/1994 Krupa
D346,554 S 5/1994 Krupa
5,348,181 A 9/1994 Smith et al.
D352,000 S 11/1994 Hansen et al.
5,363,978 A 11/1994 Molo
D353,519 S 12/1994 Wolfenden
5,392,949 A 2/1995 McKenna
5,398,843 A 3/1995 Warden
D358,091 S 5/1995 Warburton
5,425,497 A 6/1995 Sorensen
D361,696 S 8/1995 Wolfenden
5,441,166 A 8/1995 Lucas et al.
D364,090 S 11/1995 Krupa
5,490,609 A 2/1996 Lane et al.
5,509,582 A 4/1996 Robbins, III
5,538,154 A 7/1996 Von Holdt
5,538,157 A 7/1996 Proshan
5,540,350 A 7/1996 Lansky
5,542,670 A 8/1996 Morano
5,553,701 A 9/1996 Jarecki et al.
D374,820 S 10/1996 Knoss et al.
5,579,949 A 12/1996 Dykes et al.
5,607,076 A 3/1997 Anthony
5,613,619 A 3/1997 Van Melle
5,613,720 A 3/1997 Shaddy
5,624,053 A 4/1997 Freek et al.
5,695,086 A 12/1997 Viola
D391,479 S 3/1998 Poitras
D391,850 S 3/1998 Krupa et al.
5,752,646 A 5/1998 Sandstrom
5,765,716 A 6/1998 Cai et al.
5,772,111 A 6/1998 Kirsch
5,820,016 A 10/1998 Stropkay
5,839,601 A 11/1998 Van Melle
5,894,952 A 4/1999 Mendenhall et al.
D411,714 S 6/1999 Wilson et al.
D413,487 S 9/1999 Vitali
D414,413 S 9/1999 Brown
5,947,323 A 9/1999 Freek et al.
D415,024 S 10/1999 McCann
D415,025 S 10/1999 McCann
5,960,987 A 10/1999 Solland et al.
D416,445 S 11/1999 Henry
5,979,689 A 11/1999 Lansky
5,979,697 A 11/1999 Kim
D420,285 S 2/2000 Sagan et al.
D420,854 S 2/2000 Michaeli
D421,202 S 2/2000 Demers
6,089,397 A 7/2000 Van Melle
D435,197 S 12/2000 Wellner
6,176,390 B1 1/2001 Kemp
6,199,711 B1 3/2001 Lansky
6,216,904 B1 4/2001 Cagan
6,260,727 B1 7/2001 Durdon
6,296,141 B1 10/2001 Lukacevic
6,305,571 B1 10/2001 Chu
D450,537 S 11/2001 Hayes
D450,538 S 11/2001 Benson
6,311,863 B1 11/2001 Fleming
6,318,584 B1 11/2001 Milan
6,325,236 B1 12/2001 Wong
D457,037 S 5/2002 Haynes
6,419,105 B1 7/2002 Bruce et al.
D461,678 S 8/2002 Haynes
6,431,390 B1 * 8/2002 Waller ..... 220/713
6,488,173 B2 12/2002 Milan
6,533,139 B2 3/2003 Lukacevic
6,578,726 B1 6/2003 Schaefer
6,612,456 B1 9/2003 Hundley et al.
6,644,490 B2 11/2003 Clarke
6,679,397 B2 1/2004 Smith et al.
6,702,145 B2 3/2004 Malcolm
6,732,875 B2 5/2004 Smith et al.
6,755,318 B2 6/2004 Burke
6,811,049 B2 11/2004 Lukacevic
6,874,649 B2 4/2005 Clarke et al.
6,889,859 B1 5/2005 Leon
6,889,860 B2 5/2005 Mazzarolo
6,923,337 B2 8/2005 Hession et al.
6,929,143 B2 8/2005 Mazzarolo
6,991,128 B1 1/2006 Russo et al.
7,032,773 B2 4/2006 Dees et al.
7,063,224 B2 6/2006 Clarke et al.
7,086,549 B2 8/2006 Kosmyna et al.
7,100,790 B2 9/2006 Dark
7,111,749 B1 9/2006 Akers
7,131,551 B2 11/2006 Smith
7,134,566 B2 11/2006 Smith et al.
7,134,570 B1 11/2006 Heath et al.
7,156,251 B2 1/2007 Smith et al.
7,178,685 B2 2/2007 Hidalgo et al.
7,246,715 B2 7/2007 Smith
7,757,886 B2 7/2010 Ho
7,959,029 B2 6/2011 Whitaker et al.
7,980,432 B2 7/2011 Brannon et al.
8,052,003 B2 11/2011 Burns
D659,465 S 5/2012 Burns
D660,077 S 5/2012 Burns
D673,809 S 1/2013 Burns

(56) References Cited

U.S. PATENT DOCUMENTS

| | | | | |
|---|---|---|---|---|
| 2002/0011494 | A1* | 1/2002 | Lukacevic | B65D 43/0212 220/713 |
| 2002/0038803 | A1 | 4/2002 | Malcom | |
| 2002/0096530 | A1 | 7/2002 | Waller | |
| 2003/0089713 | A1 | 5/2003 | Belt et al. | |
| 2004/0232154 | A1 | 11/2004 | Smith et al. | |
| 2005/0072787 | A1* | 4/2005 | Morris | B65D 43/0218 220/712 |
| 2005/0087539 | A1 | 4/2005 | Waller | |
| 2005/0098581 | A1 | 5/2005 | Long et al. | |
| 2005/0173443 | A1* | 8/2005 | Crudgington | 220/713 |
| 2005/0205587 | A1 | 9/2005 | Sampson et al. | |
| 2005/0267425 | A1 | 12/2005 | Castora et al. | |
| 2006/0006184 | A1 | 1/2006 | Bohman | |
| 2006/0096983 | A1 | 5/2006 | Patterson | |
| 2006/0124645 | A1 | 6/2006 | Peitersen | |
| 2006/0249476 | A1 | 11/2006 | Albers et al. | |
| 2007/0131691 | A1* | 6/2007 | Evans | 220/254.5 |
| 2008/0011762 | A1 | 1/2008 | Boone | |
| 2008/0054027 | A1 | 3/2008 | Skillin et al. | |
| 2008/0156802 | A1 | 7/2008 | Yauk et al. | |
| 2008/0156817 | A1 | 7/2008 | Roseblade et al. | |
| 2009/0050641 | A1 | 2/2009 | Ivey | |
| 2009/0065518 | A1 | 3/2009 | Carnevali | |
| 2009/0108006 | A1 | 4/2009 | Milan | |
| 2009/0294460 | A1 | 12/2009 | Hovsepian et al. | |
| 2010/0065588 | A1 | 3/2010 | Brannon et al. | |
| 2010/0108701 | A1 | 5/2010 | Lee et al. | |
| 2010/0133272 | A1* | 6/2010 | Whitaker | B65D 43/0212 220/254.1 |
| 2012/0199584 | A1* | 8/2012 | Pensak | 220/254.1 |
| 2014/0299614 | A1 | 10/2014 | Mithal | |

OTHER PUBLICATIONS

PCT Search Report, PCT Application No. PCT/US2006/040392, dated May 8, 2007, 1 page.

PCT Search Report, PCT Application No. PCT/US2009/068265, dated Feb. 4, 2010, 1 page.

PCT Search Report & Written Opinion, PCT Application No. PCT/US2014/032925, dated Aug. 5, 2014, 12 pages.

* cited by examiner

SPLASH AND SPILL RESISTANT LID

RELATED APPLICATIONS

This application claims the benefit of U.S. Provisional Patent Application No. 61/808,653, filed Apr. 5, 2013, which is herein incorporated by reference in its entirety for all purposes.

FIELD OF THE INVENTION

This invention relates to lids for use with drinking vessels, and more particularly to splash and spill resistant lids for drinking vessels which may be disposable or reusable.

BACKGROUND OF THE INVENTION

Drinking cups, coffee cups, and other types of drinking vessels and containers, from which a beverage can be consumed, are frequently used in combination with a cooperating lid. Some lid designs require removal of the lid from the drinking vessel for consuming the beverage contained therein; however, most commercial drinking cup lids today are adapted for attachment to the cup rim and feature a drink-through opening which allows a user to consume the beverage contained in the drinking vessel without removing the lid therefrom. Note that herein the terms "cup" and "vessel" are used generically to refer to all types of vessels and/or containers from which a beverage may be consumed.

Commonly used coffee cup lids typically feature a drink-through opening proximate to the perimeter of the lid in the form of a small unobstructed aperture or hole within the lid that allows a person to drink coffee or other beverage without removing the lid from the cup. In addition, at least one separate vent hole is often included in a disposable lid so as to allow air to enter the cup and equalize the pressure inside the cup as the beverage is consumed.

Of course, while providing a drink-through opening in a coffee cup lid facilitates consumption of the beverage without separating the lid from the drinking vessel, it also creates a risk that beverage could be inadvertently splashed or spilled out through the opening if the cup is inadvertently tipped or jostled, or is subjected to sudden acceleration or deceleration. These situations are often encountered when the cup or other drinking vessel is being transported, whether by hand, within a cup holder in a moving vehicle, or while walking, climbing stairs, or traveling in an elevator or escalator.

Inadvertent spilling and splashing can create dangerous situations when a user is driving or moving. With today's busy lifestyle, consumption of beverages on-the-go has become commonplace, and inadvertent spilling and splashing of a beverage can be particularly irksome and embarrassing for a user when en route to work or to a professional and/or social engagement. The term "spilling" as generally used herein refers to inadvertent flowing of a beverage out of a cup or drinking vessel; and, the term "splashing" as generally used herein refers to the inadvertent ejection or scattering from a cup of beverage droplets or modest quantities of beverage that become airborne due to sudden and/or rapid movement or halting of the drinking vessel.

It will be appreciated by those skilled in the art that lids for use with cold beverages such as sodas often include holes that fit snuggly around drinking straws, whereby the length of the straw effectively prevents splashing and spilling. However, straws are typically not practical, or at least are not preferred, when consuming a hot beverage such as tea, coffee, or hot chocolate.

Lids designed for use with hot beverages sometimes include small holes or flaps near their rims that can be opened for drinking. However, turbulence or "sloshing" of a beverage when the cup has substantial quantities of beverage therein can easily lead to spilling of some liquid out from the hole, and jostling of the cup can cause liquid to splash or spill through such a hole or flap.

A drainage well is sometimes provided in a disposable lid so that small amounts of liquid that do spill or splash inadvertently from the drinking hole (or through a vent hole) will pool in a designated region of the lid and drain back into the cup. However, such drainage wells are typically shallow, and are only effective if the cup is maintained in a near-vertical orientation. In certain situations, additional jostling may even cause liquid to splash or spill out of the drainage well before it has drained back into the cup.

A drinking hole is sometimes placed at the top of a raised spout, so as to reduce the likelihood that liquid will spill or splash from the drinking hole. However, since the drinking hole is in the direct path of a beverage splash, liquid is still able to splash through the drinking hole if the cup is shaken or jostled with sufficient force, for example if the beverage is being consumed while traveling in a vehicle and the vehicle drives over a pot hole or other uneven feature in the road, or is forced to brake or maneuver suddenly.

Various types of lids with closable drinking holes and/or spouts have been proposed and/or are in use. Some provide a rotatable second piece that can seal the drinking hole, while others provide a tethered cap or plug that can be used to seal the drinking hole. However, these approaches only provide protection from spilling and splashing when the drinking hole is closed or blocked, and do not naturally inhibit spilling and splashing when open. Furthermore, when the drinking hole is closed or blocked it also prevents a user from consuming the beverage. It will be appreciated by those of ordinary skill that these lids tend to be multi-piece constructions, and may be generally more expensive to produce than a one-piece construction lid. Furthermore, once a user has unplugged the drink-through opening the lid essentially functions as an open-spout lid, as it would be too cumbersome for a user to plug and unplug the drinking hole manually each time a portion of beverage is to be consumed.

Another approach is to provide a two-piece or multi-piece lid assembly comprising a separate insert that can be placed either on a cup or underneath a lid, wherein the separate insert has fluid passages that are not aligned with the drinking and vent openings in the lid, thereby preventing straight-line travel by splashed, airborne droplets from the cup interior through a lid opening, and forcing the beverage to flow through a convoluted path before exiting through the lid. While this approach may provide good splash resistance, it presents some practical hurdles. If the insert and the lid are required to be installed by a consumer, then it may be inconvenient and cumbersome for the consumer. Also, separate inserts can become dislodged or can shift in position, and can therefore be unreliable. This is true even if the insert is loosely attached to the lid or separately attached to the rim of the cup. On the other hand, if this solution is implemented by a lid manufacturer, it raises the cost of the lid since manufacturing involves providing and installing a separate insert within a lid as part of a secondary operation. In addition, since an insert can become dislodged or shift in position, reliable assembly may also require joining the insert and the lid via fastening, gluing, and/or bonding operations, further rendering the lid-assembly even more expensive.

A one-piece splash and spill resistant lid is described in US Pat. Pub. 20100133272 to Whitaker et al. (Whitaker '272) and assigned to the assignee of the present invention. Whitaker '272 describes a variety of lid constructions wherein the spout openings have been manipulated to have constricted dimensions which can be disposed in the spout well. However, it has been found that while constricting the openings provides some degree of splash resistance, a user may still be exposed to splashing hazards from hot beverages.

What is needed, therefore, is an improved splash and spill resistant lid for use with a drinking cup that enables drinking of a beverage without requiring separation of the lid from the drinking cup, while also inherently inhibiting or at least minimizing inadvertent spilling and splashing of the beverage from the cup, without requiring deployment of manual plugs or blocking devices. These and other needs, as shall hereinafter appear, are met by the device of the present invention.

SUMMARY OF THE INVENTION

At the core of the present invention is the confluence of two insights that provided unexpected improvements in splash performance of a coffee cup lid, namely that (1) by adjusting the location, orientation, size and shape of the opening(s) in the dispensing well and/or spout of a one-piece lid, any inadvertent splashing from the lid can be significantly reduced and directed away from the user when a user is holding a beverage-filled lidded cup in a normal fashion for consuming the beverage therefrom; and (2) by providing a baffle around the dispensing well opening(s) and creating a constricted flow channel, the amount of splashing that escapes the dispensing well opening(s) and ultimately through the lid can be appreciably reduced.

A lid for a drinking cup according to an embodiment of the invention includes a drinking spout, a dispensing well formed in the drinking spout, and a plurality of baffle walls disposed between the dispensing well and a front spout wall, the spaces between baffle walls and front spout wall defining a plurality of channels terminating in one or more openings that direct a beverage into the dispensing well formed in the drinking spout. The baffle walls serve to reduce the volume of splashed fluid that may find a pathway to the dispensing well openings while enhancing the suppression of spilled liquid and splashed droplets, due to increased contact between the liquid and the baffle walls, and the resulting increase in surface tension resistance to flow.

The dispensing well openings and baffle walls are configured to block substantially all direct paths for a liquid beverage to splash out of the cup, by requiring that splashed liquid must impact the inner walls of the lid and change direction at least twice before exiting. For a steady flow of liquid, when the cup is tipped during normal drinking, there is ample liquid pressure to cause the liquid to flow freely out of the cup. However, when the beverage inside a generally upright cup is in turbulence caused by abrupt acceleration or deceleration in a vehicle, or by general movement and shaking of user's hands while walking, a mass of fluid may be agitated upwardly and impact the lower edge of the baffle walls, The fluid-mass will then be sub-divided into the respective channels and the momentum and kinetic energy of the fluid mass will be substantially reduced, due at least in part to surface tension and frictional effects. In other words, the retarding effect created by the resistance between the liquid and the baffle walls, combined with the relatively low mass of the sub-divided stream of fluid in a channel, tend to decrease the momentum of the initial splash significantly and decrease the likelihood that a small spill or droplet will fully exit the cup during a splashing event.

Depending on the nature of the liquid and the splashing event, a splashed fluid mass may be comparable or larger in size than the channels and/or the dispensing well openings, thereby causing a portion of the splashed fluid mass impinging the bottom edges of the baffle walls to be diverted back into the cup, while the rest of the splashed fluid mass is subdivided into the respective channels between the baffle walls. The division of the splashed fluid into multiple channels will increase the resistance to flow, and possibly force the fluid mass to break into relatively small droplets before it can pass through the lid openings and exit from the cup. As a result, all but the most energetic droplets will be blocked from exiting the cup.

In embodiments, the dispensing well openings direct any splashed liquid toward the center of the lid. Since the spout is typically oriented toward a user when a cup is held or otherwise supported in a generally vertical orientation, this means that any splashed droplets that somehow pass through the dispensing well openings are directed away from the user.

Various embodiments include one or more vent holes in the lid that permit air to enter the cup and equalize the internal pressure as a beverage is consumed. Certain of these embodiments include a plurality of vent holes. In some of these embodiments, the plurality of vent holes includes vent holes of different sizes that are selectively located so as to control the maximum rate at which a beverage can flow from the cup.

In some embodiments designed to hold hot beverages, one or more vent holes are located in proximity to the drinking spout or the dispensing well, so that when the cup is full and the beverage in the cup is hot, tipping of the cup from vertical beyond a certain angle causes the beverage to block vent holes near the dispensing well, thereby reducing the rate of liquid flow out of the cup. It will be appreciated by those skilled in the art that a typical user tilts the cup towards his or her mouth to consume the beverage therefrom, and has a tendency to consume the beverage in smaller sips when the beverage is hot. Thus, blocking of some of the vent holes complements the natural tendency of the user to consume beverage at a slower rate when the cup is full and the beverage is hot. As the cup is emptied and the beverage cools, the level of liquid falls, and some of the previously blocked vent holes are uncovered, thereby increasing the liquid flow rate.

The present invention is a lid for use with a drinking vessel that includes a peripheral rim configured for engaging with said drinking vessel, a drinking spout; said drinking spout having a spout front wall extending upwardly from said peripheral rim, and a spout top wall connected to said spout front wall, a dispensing well formed within said spout top wall, said drinking spout and said dispensing well being configured for allowing consumption of a beverage contained within an interior of said drinking vessel by a user, said dispensing well comprising at least a well front wall and well bottom wall, wherein said bottom wall is closed for substantially blocking direct line-of-sight pathways for the beverage in said drinking vessel, at least one opening provided in said well front wall of said dispensing well for allowing flow of said beverage from the interior of said drinking vessel through said dispensing well, and at least one baffle surrounding said opening, said baffle serving as a splash deflector and providing a fluid channel path between the interior of said drinking vessel and said at least one opening.

In embodiments, said well front wall of said dispensing well is proximate said spout front wall. In some embodiments, said at least one opening has an area of less than 0.1 $cm^2$.

In various embodiments said bottom wall of said dispensing well is inclined to allow beverage contained within the dispensing well to flow through said opening and drain back into the interior of the drinking vessel when the drinking vessel is held or otherwise supported vertically.

Other embodiments further include at least one vent hole that provides air communication between the interior of the drinking vessel and air exterior to the lid.

Embodiments further include a plurality of vent holes that admit air into the interior of the drinking vessel as the beverage in the drinking vessel is consumed. In some of these embodiments, at least a first vent hole amongst said plurality of vent holes is located proximate said dispensing well.

Various embodiments include a plurality of vent holes, wherein at least a first vent hole amongst said plurality of vent holes is configured for being blocked by said beverage in the interior of said drinking vessel when said drinking vessel is tipped by said user for consuming the beverage.

Some embodiments further include a plurality of vent holes, wherein said plurality of vent holes includes a plurality of vent hole sizes.

And other embodiments further include a plurality of vent holes, located at a plurality of proximities from said dispensing well, wherein at least one vent hole amongst said plurality of vent holes is blocked by said beverage when the drinking vessel is tipped from an upright position.

In various embodiments at least one surface of the lid includes at least one of a texture and a protruding structure configured to influence flow of said beverage across said at least one surface.

In certain embodiments, said lid is constructed from at least one of paper, plastic, thermoplastic resin, foam, a laminated material, a compostable resin, and a biodegradable material.

In further embodiments, said lid is manufactured by one of thermoforming, injection molding, compression molding, vacuum forming, pressure forming, and hydro forming.

In some embodiments, said lid is injection molded from a suitable grade of polypropylene resin. In other embodiments, said lid is injection molded from a plastic material.

In various embodiments, said lid is disposable. And in certain embodiments said beverage is a drinkable fluid that is one of tea, coffee, soup, shake, juice, and milk.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

The present invention is generally directed towards a lid that engages with a drinking cup or a similar vessel and allows a user to drink therefrom while naturally inhibiting splashing and spilling of beverage from the drinking cup. The following description of one or more exemplary embodiments, in conjunction with accompanying drawings of representative lids, is offered as illustrative of the invention, but should not be regarded as restricting the scope of the invention.

As noted elsewhere, the lid constructions according to various embodiments of the invention offer particular utility for disposable drinking cups, which are typically used for holding cold and hot beverages and are generally constructed from paper, plastic or foam materials. It will be apparent to those skilled in the art that the lid embodiments described herein can also be utilized and/or adapted for reusable cups and drinking vessels. Depending on the embodiment, the lid of the present invention can be utilized for consuming all kinds of hot and cold beverages, including coffee, tea, soup, shakes, frappes, and slush drinks. According to still other embodiments of the invention, the lid spout and dispensing well constructions can be used for dispensing fluid materials including dressing, vinegar, coffee cream etc.

Figure 1:
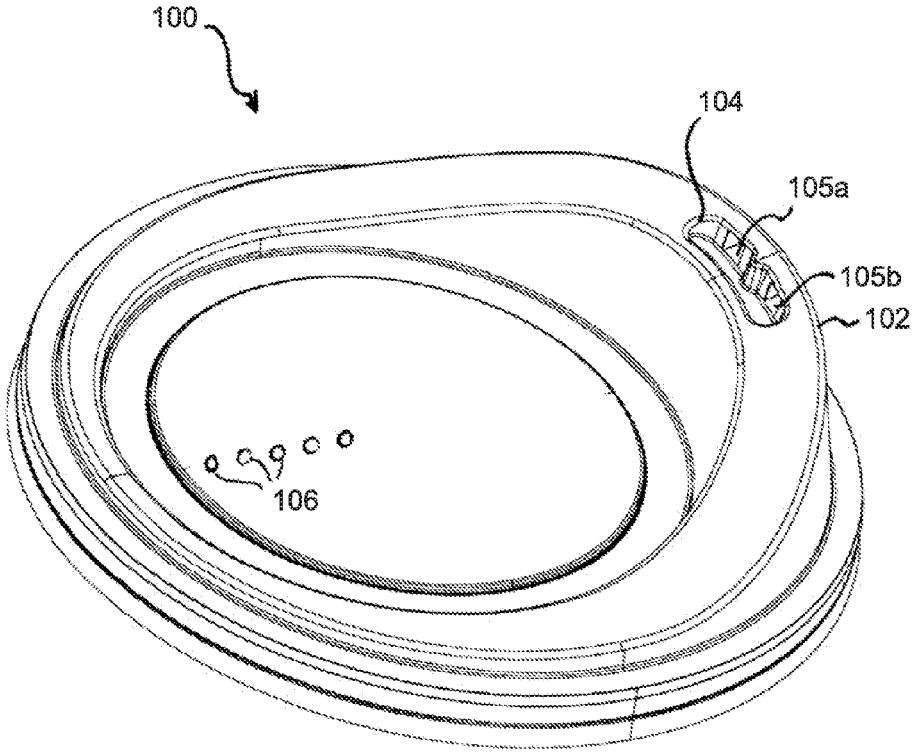
FIG. 1 is a perspective side view of an embodiment of the present invention that includes a plurality of vent holes aligned radially in a portion of the lid opposite to the drinking spout.

With reference to the perspective view of FIG. 1, there is shown lid 100 according to an embodiment of the present invention. Lid 100 is designed to be securely but removably attachable along the periphery of a drinking cup (not shown) as is known in the art. Lid 100 includes a drinking spout 102, a dispensing well 104, and a pair of dispensing well openings 105*a* and 105*b*. The dispensing well openings 105*a* and 105*b* have a nearly vertical orientation, such that direct line-of-sight paths for beverage splashes are avoided, or at least minimized. It will be realized that, for ease-of-molding and manufacturability reasons, it will be desirable in some embodiments that the openings 105*a* and 105*b* lie in a plane that is at a slight angle to the vertical. Lid 100 also includes a plurality of vent holes 106 configured for allowing air to flow into the cup in response to beverage flowing out of the spout 102.

It will be apparent that the plurality of vent holes 106 can be replaced with a single vent hole of a larger size. However, it will be recognized by those skilled in the art that a larger vent hole may also allow beverage to splash from the vent hole if the area of the vent hole exceeds a certain threshold size. Based on experiments, the vent hole diameter must be less than 0.060 inches to prevent splashing through the vent hole under normal conditions, and preferably less than 0.040 inches. In certain embodiments the vent hole diameter is about 0.032 inches. Vent holes with diameters less than 0.032 inches can be employed by using a larger number of vent holes. Nonetheless, it will be apparent to those skilled in the art that the location, size, shape and the number of vent holes can be varied according to the features and flow performance desired, as discussed below.

Figure 2:
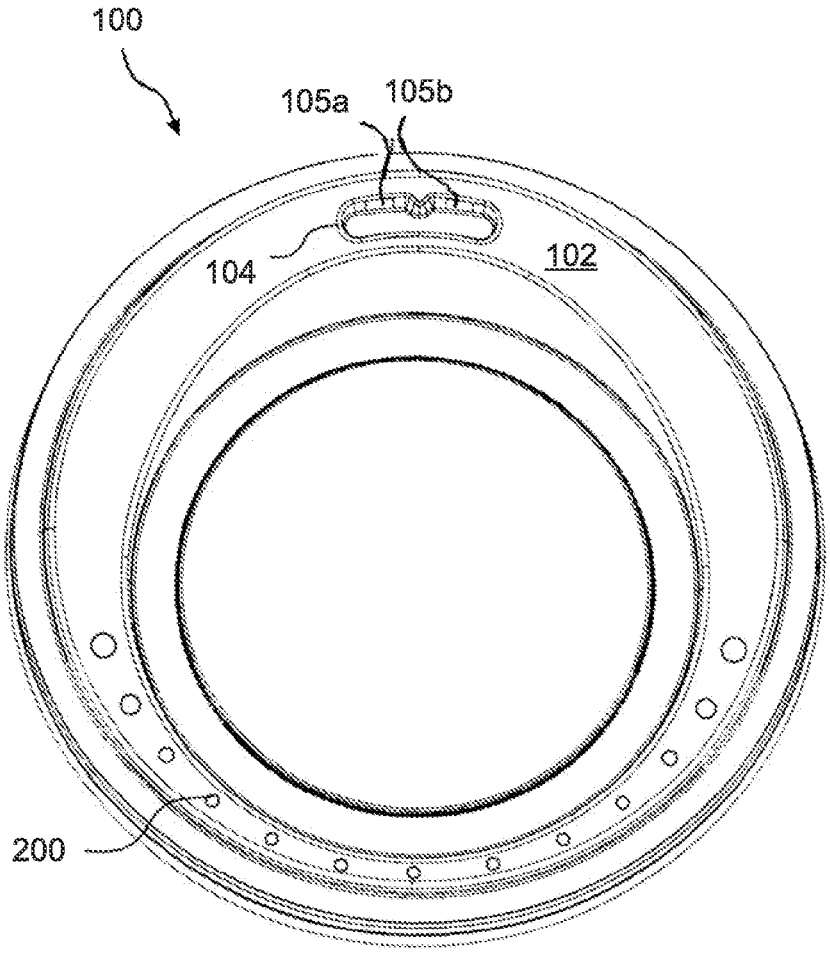
FIG. 2 is a top view of an embodiment similar to FIG. 1, except that the plurality of air vents are located about the periphery of the lid opposite to the drinking spout.

FIG. 2 illustrates a lid 100 in another embodiment having the same drinking spout construction as is shown in FIG. 1, but with a different arrangement of vent holes 200. In the embodiment of FIG. 2, the vent holes 200 are located in the periphery of the lid 100 in a region opposite to the drinking spout 102. This configuration allows placement of a larger number of vent holes. In the illustrated embodiment the vent holes 200 vary in size, but it will be realized that the holes can all be the same size, or a larger vent hole can be substituted with two or more smaller vent holes, depending on the vent hole diameter needed for preventing splashes as discussed above.

It has been found that smaller dispensing well openings according to embodiments of the present invention provide greater splash resistance but require larger numbers of vent holes (larger combined vent hole area) for achieving a desired beverage flow through the drinking spout. Thus, by restricting the dispensing well openings and using a larger number of vent holes, improved splash resistance is achieved. According to an embodiment of the invention, the lid 100 comprises at least one dispensing well opening having a total area of less than 0.06 $in^2$ (square inches) and preferably less than 0.04 $in^2$. According to another embodiment of the invention, the lid comprises at least two dispensing well openings having a combined area of less than 0.04 $in^2$, and preferably less than 0.03 $in^2$.

According to still another embodiment of the invention the lid comprises a plurality of dispensing well openings wherein at least one individual dispensing well opening has an area of less than 0.03 $in^2$, and preferably less than 0.02 $in^2$. In another embodiment of the invention, at least one individual dispensing well opening has an area of less than 0.01 $in^2$. According to yet another embodiment of the invention, each individual dispensing well opening has an area of less than 0.015 $in^2$. It will be recognized that in embodiments comprising a plurality of dispensing well openings, individual openings may be of equal or unequal size.

According to yet another embodiment of the invention, the lid comprises a plurality of dispensing well openings wherein each individual dispensing well opening has an area greater than 0.003 $in^2$, and preferably greater than 0.005 $in^2$. Thus, in accordance with the above, by adjusting the size and number of dispensing well openings and the size and number of vent holes, a lid can be optimized for yielding desired beverage flow and drinking ease.

Figure 3:
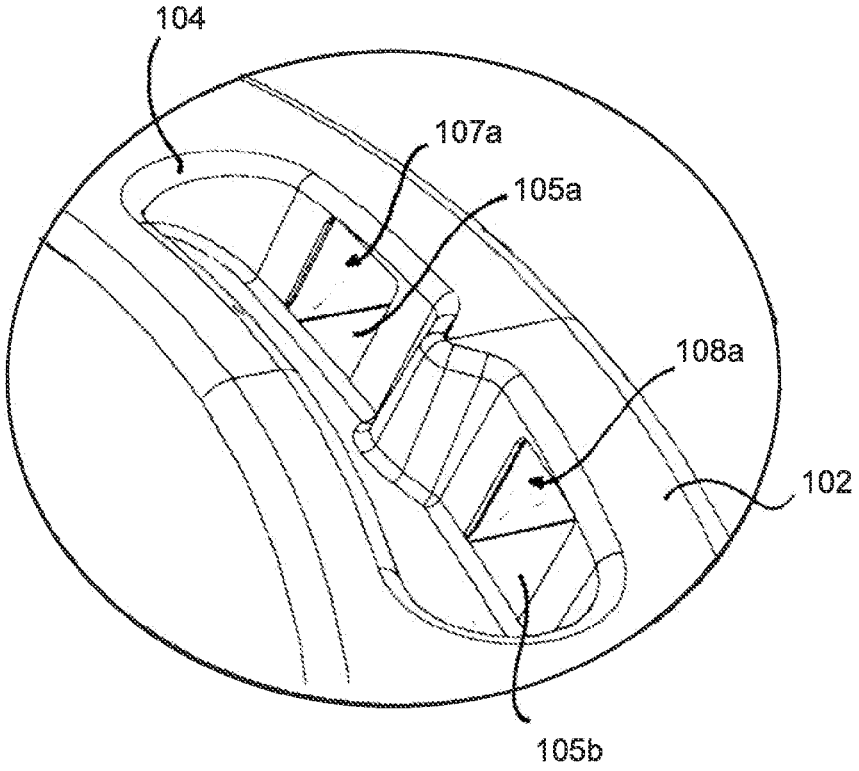
FIG. 3 is a close-up perspective view of the dispensing well in the lid according to the embodiments shown in FIGS. 1 and 2.

FIG. 3 is a close-up view of the dispensing well 104 and spout 102 of the lid shown in FIG. 2. A pair of openings 105*a* and 105*b* are included in the dispensing well 104. Dispensing well openings 105*a* and 105*b* allow beverage from the cup to enter the dispensing well 104 for consumption by a user. Baffles 107 and 108 are provided on the underside of lid 100 around openings 105*a* and 105*b* respectively to provide a channeled flow of beverage from the cup through openings 105*a* and 105*b*, and to reduce the momentum of splashed fluid mass and minimize inadvertent splashing. The baffle structure can be created by a plurality of baffle walls, as is most clearly shown in FIG. 5, which is discussed in more detail below. The baffle walls of each baffle are indicated in the figures by adding a distinct alphabetical suffix to the baffle numeral. Baffle 107 comprises baffle walls 107*a*, 107*b* and 107*c*; similarly, baffle 108 includes baffle walls 108*a*, 108*b* and 108*c*. In FIG. 3, only baffle walls 107*a* and 108*a* are visible.

Figure 4:
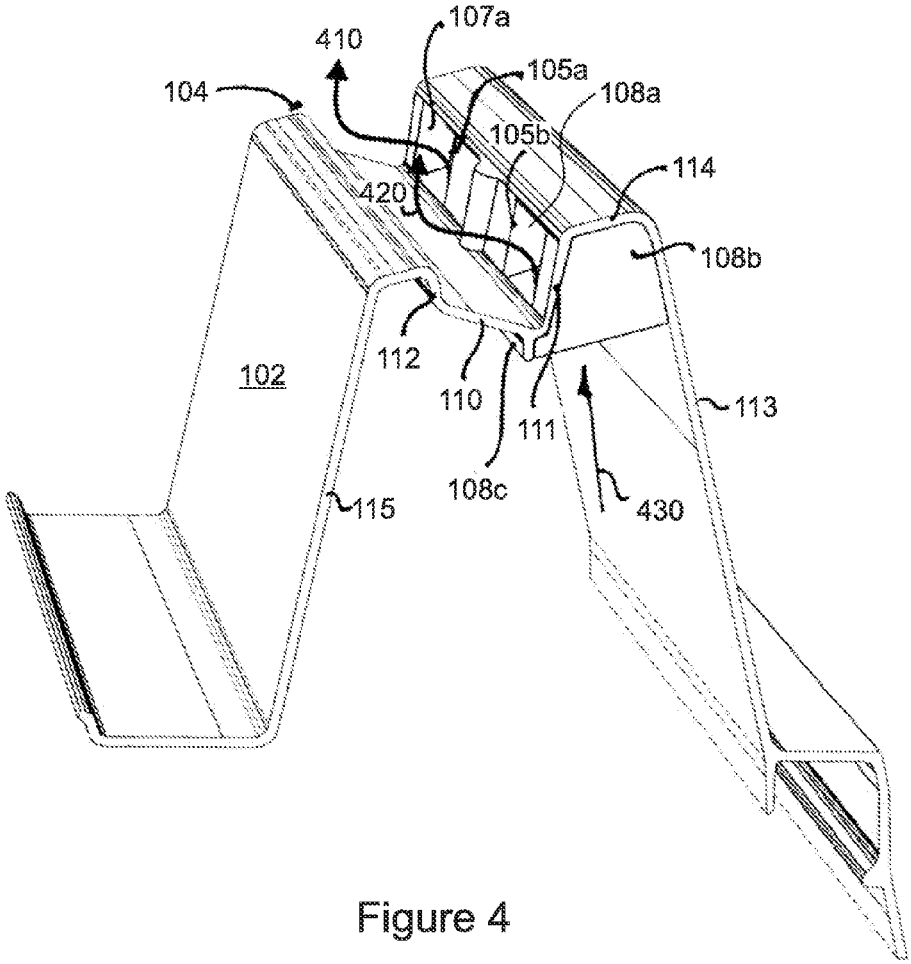
FIG. 4 is a close-up perspective view of a section of a drinking spout in the embodiments of FIGS. 1 and 2, showing baffle walls forming a pair of vertical columns and a pair of dispensing well openings that allow beverage to flow into the dispensing well during normal drinking.

FIG. 4 is a close-up perspective view of a section of the drinking spout 102 and dispensing well 104 of the lids shown in FIGS. 1 and 2, further describing the construction of the splash resistant features according to an embodiment of the invention. Spout 102 has a spout front wall 113, a spout back wall 115 and a spout top wall 114. Dispensing well 104 is provided in the spout top wall 114. During general beverage consumption, the spout front wall 113 is in contact with a user's lower lip while the back wall 115 is in contact with a user's upper lip, and the dispensing well 104 is suitably sized to allow beverage flow into the user's mouth. Dispensing well 104 has a generally inclined bottom wall 110, a front wall 111 and a back wall 112. Front wall 111 is interrupted by openings 105*a* and 105*b* that allow beverage to flow from the cup into the dispensing well. Bottom wall 110 is inclined towards dispensing well openings 105*a* and 105*b* to allow small quantities of beverage remaining in the dispensing well to be drained back into the cup via dispensing well openings 105*a* and 105*b*. Baffle walls 107*a*, 107*b*, 108*a*, and 108*b* extend internally from the dispensing well front wall 111 to the spout front wall 113, and thereby define the separate openings 105*a* and 105*b*. Note that baffle wall 107*b* is not visible in FIG. 4.

The beverage flow through opening 105*b* is indicated by arrow 420. Similarly, beverage flow through opening 105*a* is indicated by arrow 410. In the cut-away view of FIG. 4, baffle walls 108*a*, 108*b* and 108*c* are at least partially visible. Baffle walls 108*a* and 108*b*, on either side of opening 105*b*, connect dispensing well front wall 111 to spout front wall 113, so that only beverage that is splashed upwardly in the narrow column defined by baffle walls 108*a*, 108*b* and 108*c*, and spout front wall 113 is available for egress through opening 105*b*. Similarly, baffle walls 107*a* and 107*b* on either side of opening 105*a*, connect dispensing well front wall 111 to spout front wall 113, so that only beverage that is splashed upwardly in the narrow column defined by baffle walls 107*a* and 107*b* (not shown), and 107*c* (not shown) and spout front wall 113 is available for egress through opening 105*a*.

It will be appreciated that the rest of the splashed fluid mass from the cup that does not enter the flow channels defined by baffles 107 and 108 will hit the interior surfaces of the lid and be directed back into the cup. In addition, a portion of the splashed fluid that is directed between the baffle walls will impinge against the underside of the spout top wall 114 and will also be redirected back into the cup. Thus, it will be appreciated by those skilled in the art that only a relatively small portion of the splashed fluid will escape openings 105*a* and 105*b*, since the splashed fluid will have a velocity profile that is mostly vertically upward, as denoted by arrow 430, while the exits through the openings 105*a*, 105*b* require fluid motion in a direction generally transverse to the direction of splashing, and thereafter the splashed fluid has to change direction a second time before emerging from the dispensing well 104.

As mentioned elsewhere herein, one of the advantages of this dispensing well and spout construction is that beverage splashes such as those denoted by arrows 410 and 420 are directed away from the spout front wall 113, and hence away from the user, since it is customary to hold the cup-lid assembly with the spout front wall towards the user for convenient consumption of beverage therefrom. Since the spout front wall is typically oriented toward a user when the cup is held or otherwise supported vertically, this means that any splashed droplets that somehow pass through the dispensing well openings are directed away from the user.

In certain embodiments, each of the dispensing well openings 105*a* and 105*b* has an area of less than 0.015 $in^2$ or 0.1 $cm^2$.

In certain embodiments, by including a plurality of flow directing channels defined by baffles 107 and 108 and a plurality of dispensing well openings 105*a* and 105*b*, rather than a single, larger channel and a single, larger opening having the same total cross sectional areas, a greater degree of splash resistance is obtained. This can be readily understood from the fact that the walls of a channel or orifice offer resistance to flow, while fluid can flow freely in the center of the channel or orifice. In fluid dynamics, the Hagen-Poiseuille equation describes flow through a tube or pipe and establishes the relationship between flow, pressure drop, length of the tube, diameter of the tube and other physical constants. According to the Hagen-Poiseuille equation, flow through a tube is proportion to $d^4$ where "d" is the diameter of the tube. Thus, if the diameter of a tube is halved the flow through it is reduced by 16 times. Although flow during a fluid splash is not the same as a steady flow through the same passage, it can be reasonably concluded that the flow will be considerably reduced by providing multiple smaller openings rather than one large opening having the same cross-sectional area.

In other words, providing a corresponding baffle on the underside of the lid to channel the beverage flow to the dispensing well opening(s) further enhances suppression of spilled liquid and splashed droplets due to increased contact between the liquid and the baffle walls, and the resulting increase in resistance to flow. The increased contact area with the baffle walls and reduction in cross-sectional area increases resistance to flow. In addition, it is believed that surface tension can force the fluid mass to break into smaller droplets before it can pass through the openings and exit the cup. As a result, all but the most energetic droplets are blocked from exiting the cup.

As shown in FIG. 4, the underside of the dispensing well 104 is blocked by bottom wall 110 and openings 105*a* and 105*b* are oriented to substantially block nearly all direct paths for a liquid beverage to splash out of the cup, by requiring that splashed fluid or beverage changes direction twice before exiting, as shown by the flow paths illustrated by arrows 410 and 420. For a steady flow of liquid, when the cup is tipped during normal drinking, there is ample liquid pressure to cause the liquid to flow freely out of the cup. However, when the cup is generally vertical and a fluid mass is splashed upward from the cup due to turbulence or sudden acceleration or deceleration, the structural features of the lid, including the near-vertical orientation of the dispensing well openings, the absence of direct line-of-sight flow paths to the dispensing well openings, the blocked underside of the dispensing well, and the increased flow resistance between the splashed liquid and the baffle walls, all tend to decrease the likelihood that the liquid will fully exit through the dispensing well of the lid, and further ensure that the amount of splashed fluid is minimized.

Figure 5:
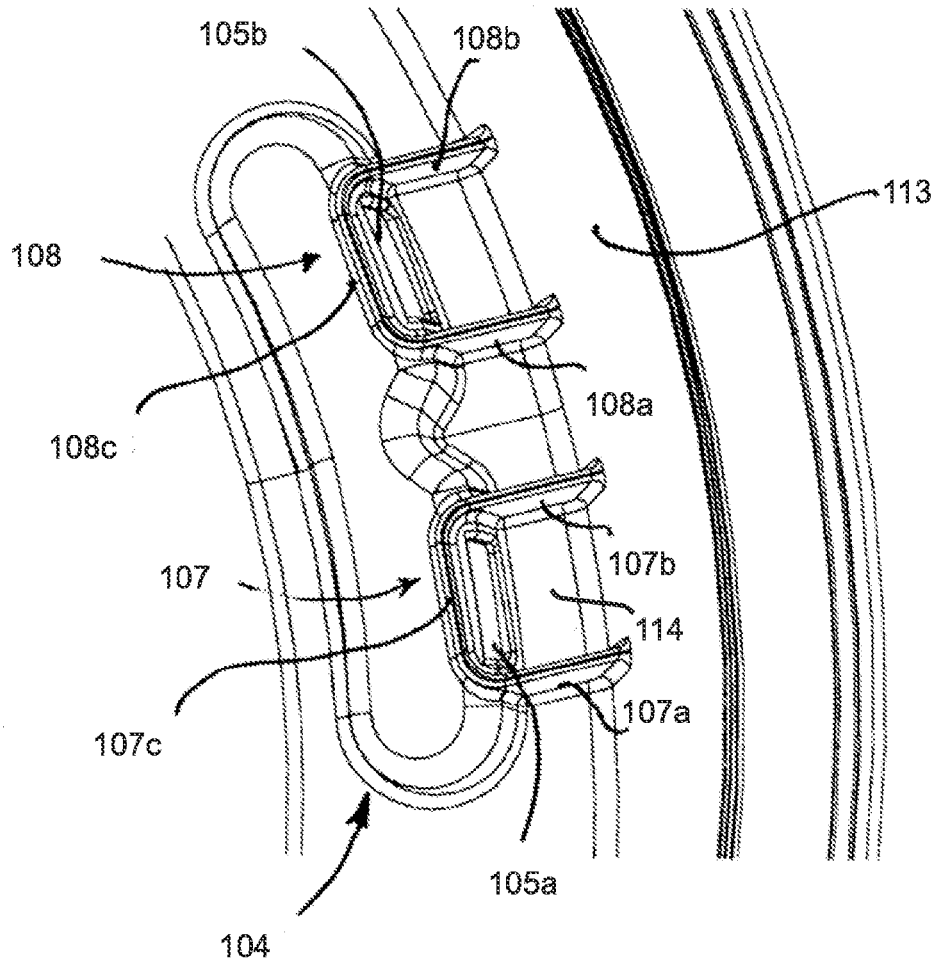
FIG. 5 is a close-up bottom view of the dispensing well and spout in the embodiment of FIGS. 1 and 2 showing a plurality of baffle walls.

FIG. 5 is a close up perspective view of the underside of the dispensing well 104 of FIGS. 1 and 2, showing the baffle structure. Opening 105*a* is bounded by baffle walls 107*a*, 107*b* and 107*c*. In the embodiment of FIG. 5, baffle walls 107*a* and 107*b* are generally parallel to one another, and are connected to the baffle wall 107*c* at one end and to the spout front wall 113 at the other end. Similarly, opening 105*b* is bounded by baffle walls 108*a*, 108*b* and 108*c*. In the embodiment of FIG. 5, baffle walls 108*a* and 108*b* are generally parallel, and are connected to the baffle wall 108*c* at one end and to the spout front wall 113 at the other end.

Baffle walls 107*a*, 107*b*, 107*c*, 108*a*, 108*b* and 108*c* serve to deflect large splashes of fluid masses from the cup, so that only fluid splashes that impinge within the channel defined by the baffle walls have the opportunity to exit through the dispensing well openings 105*a* and 105*b*. In addition, depending on the nature of the liquid and the splashing event, a splashed fluid mass may be comparable or larger in size than the cross-sectional area of the channels defined by baffles 107 and 108, thereby causing at least a portion of the fluid mass to be deflected back into the cup and significantly retarding the remaining fluid mass that enters the channel or confinement created by the baffle walls and the spout front wall as discussed above.

Embodiments of the present invention include a texture or a protruding structure on at least one inner wall that is configured to influence flow of beverage across the surface. Thus, for example a rough texture or ribs or ridges can be provided on the baffle walls 107*a*, 107*b*, 107*c*, 108*a*, 108*b*, 108*c* or the spout front wall 113. Ribs or ridges can also be provided on the surfaces of the dispensing well 104.

Figure 6:
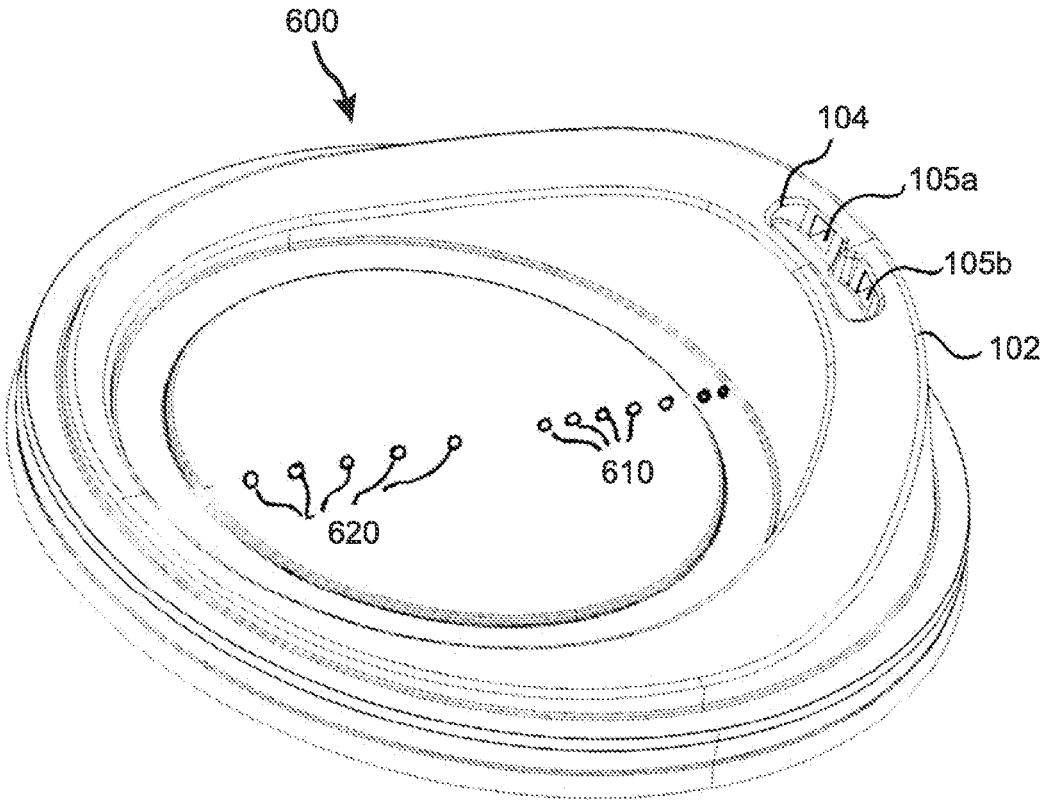
FIG. 6 is a perspective view of a lid according to an embodiment similar to FIG. 1, except that pluralities of vent holes are provided at various locations relative to the lid for regulating beverage flow through the spout.

With reference to FIG. 6, there is shown a lid 600 according to another embodiment of the invention having a spout construction 102 similar to the lid of FIGS. 1 and 2, wherein like parts are designated by like reference numerals. Lid 600 features a plurality of vent holes 610, 620, some of which 610 are closer to the drinking spout 102 while others 620 are further away from the drinking spout 102. For ease of description, the plurality of vent holes are labeled as two series of vent holes designated by reference numerals 610 and 620. The vent holes designated by reference numerals 610 are closer to the spout 120, while the vent holes further away from the spout are designated by reference numeral 620. Vent holes 610 or 620 can be of the same size or different sizes, as discussed previously.

Lid 600 is particularly adapted for use with hot beverages, by locating one or more vent holes 610 near the dispensing well 104, so that when the cup is full and the beverage in the cup is hot, tipping of the cup from vertical beyond a certain angle will cause the beverage to block nearly all of the vent holes 610 near the dispensing well 104, thereby reducing the rate of liquid flow. As the cup is emptied and the beverage cools, however, the level of liquid will fall, and some of the previously blocked vent holes 610 will be uncovered, thereby increasing the liquid flow rate.

Vent holes 620 are placed such that they are not blocked during normal drinking, thereby allowing air to flow into the cup as fluid is depleted from the cup. By selectively placing a plurality of vent holes 610 near the spout 102, beverage flow through the drinking spout 102 can be regulated, thereby helping to protect a user from accidental burns or discomfort caused by an initial large swig of a very hot beverage.

The effectiveness of the present invention in reducing the escape of splashed liquid and droplets from the cup was documented by tests that compared splashing from the embodiment of FIG. 2 with splashing from two types of prior art lids. The splash resistance testing was performed on lidded cups in 4 types of movements—up and down motion, sideways motion, back and forth motion, and circular motion. Tests were conducted by filling a 16 oz cup with water to a fill level of 14 oz. and then lidding the cup. The filled cup-lid assembly was weighed at the beginning of each test and water loss was measured in grams after subjecting it to 10 repetitive cycles in each test configuration. Thus, over the entire test the respective lidded-cup assemblies were subjected to forty (40) splashing opportunities. The resulting data are shown in Table 1, which illustrates that the total fluid loss over four tests and 40 splashing opportunities for open spout configuration lids being commercially sold in the marketplace today was over 21 grams, while fluid loss was less than 6 grams for the assembly according to the present invention. The measured reduction of splashed liquid as compared to prior art cups was therefore 72%.

TABLE 1

TABLE 1: WATER LOSS IN 10-CYCLES OF MOVEMENT MEASURED IN GRAMS

| Lid Type | Loss In Up and Down Motion | Loss In Side-to-Side Motion | Loss In Back and Forth Motion | Loss In Circular Motion | Total Water Loss for All Tests | Percent Improvement over Open Spout Lids |
|---|---|---|---|---|---|---|
| Open Spout (Mfr. A) | 9.03 | 1.85 | 6.67 | 3.52 | 21.07 | — |
| Open Spout (Mfr. B) | 10.64 | 1.47 | 6.74 | 2.67 | 21.52 | — |
| Present Invention | 1.91 | 1.57 | 2.06 | 0.41 | 5.95 | 72% |

Figure 7:
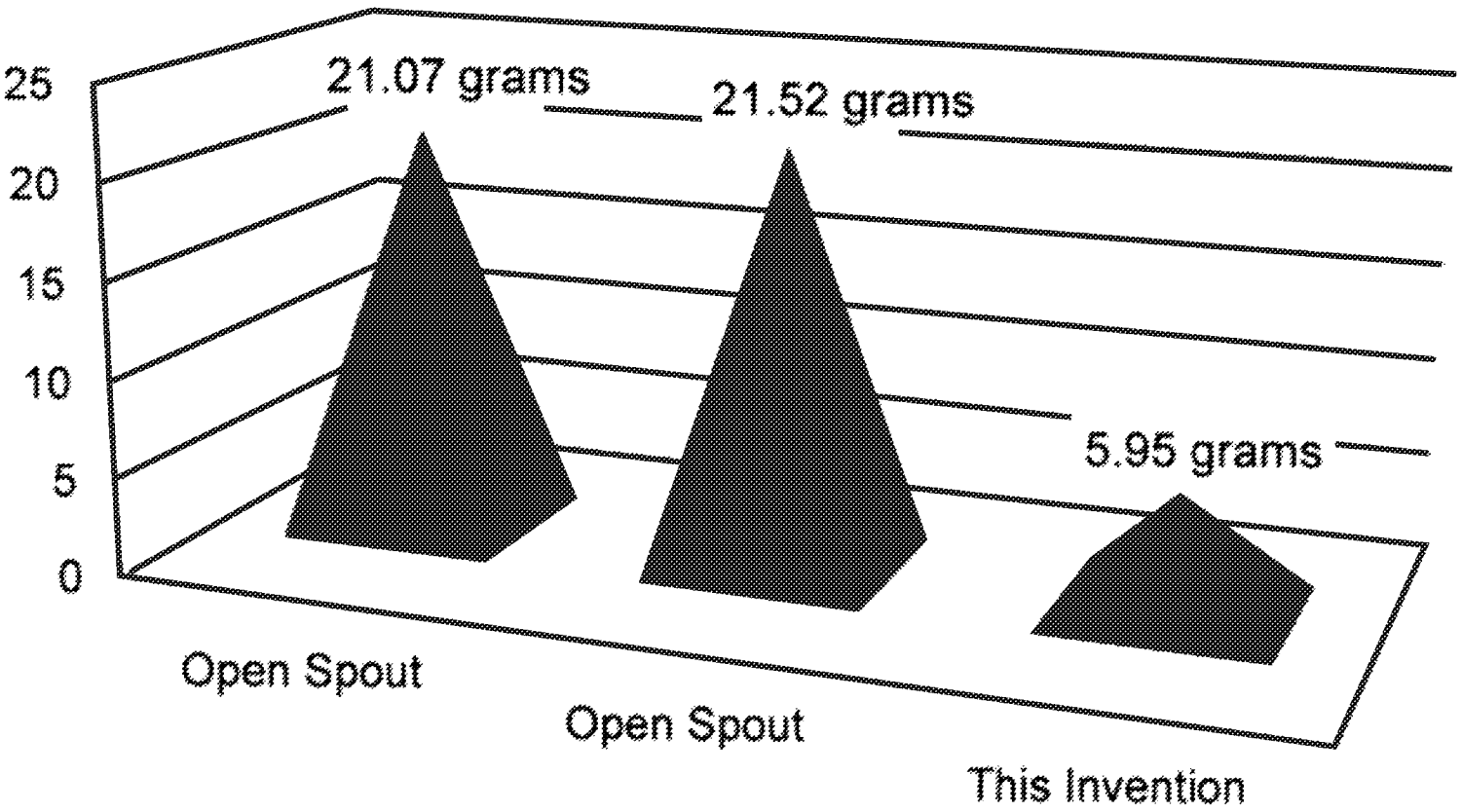
FIG. 7 is a graphical representation comparing the splashed fluid losses for a prior art open spout lid and a lid according to an embodiment of the present invention.

A graphical presentation of the data of Table 1 is shown in FIG. 7. While a reduction of over 72% in splashed fluid is significant, in order to fully appreciate the improvement provided by the present invention it must be realized that while the directions of the splashes from the open spout configurations were unpredictable, the splashed fluid from the lid of the present invention was consistently directed away from the spout front wall and from the user, thus further protecting the user from any spill mishaps.

The foregoing description of the embodiments of the invention has been presented for the purposes of illustration and for providing a general understanding of the invention. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A lid for use with a drinking vessel, said lid comprising:

a peripheral rim configured for engaging with said drinking vessel;

a lid top surrounded by said peripheral rim;

a drinking spout, said drinking spout having a spout front wall extending upwardly from said peripheral rim, a spout rear wall extending upwardly from said lid top, and a spout top wall extending between said spout front wall and said spout rear wall, said spout top wall being thereby elevated above said lid top so as to allow simultaneous placement of a user's upper lip against said spout rear wall and the user's lower lip against said spout front wall;

a dispensing well formed within said spout top wall; said drinking spout and said dispensing well being configured for allowing consumption of a beverage contained within an interior of said drinking vessel by a user;

said dispensing well comprising at least a well front wall and well bottom wall, wherein said bottom wall is closed and unpenetrated for substantially blocking direct line-of-sight vertical pathways for the beverage in said drinking vessel;

at least one opening provided in said well front wall of said dispensing well for allowing flow of said beverage from the interior of said drinking vessel through said dispensing well; and a pair of baffles extending from said well front wall to said spout front wall, said at least one opening being between said baffles;

a fluid channel path being thereby formed between said baffles through which said beverage must flow from the interior of said drinking vessel so as to reach said at least one opening.

2. The lid of claim 1, wherein said well front wall of said dispensing well is proximate said spout front wall.

3. The lid of claim 1, wherein said at least one opening has an area of less than 0.1 $cm^2$.

4. The lid of claim 1, wherein said bottom wall of said dispensing well is inclined to allow beverage contained within the dispensing well to flow through said opening and drain back into the interior of the drinking vessel when the drinking vessel is held or otherwise supported vertically.

5. The lid of claim 1, further comprising at least one vent hole that provides air communication between the interior of the drinking vessel and air exterior to the lid.

6. The lid of claim 1, further comprising a plurality of vent holes that admit air into the interior of the drinking vessel as the beverage in the drinking vessel is consumed.

7. The lid of claim 6, wherein at least a first vent hole amongst said plurality of vent holes is located proximate said dispensing well.

8. The lid of claim 1, further comprising a plurality of vent holes, wherein at least a first vent hole amongst said plurality of vent holes is configured for being blocked by said beverage in the interior of said drinking vessel when said drinking vessel is tipped by said user for consuming the beverage.

9. The lid of claim 6, wherein said plurality of vent holes includes a plurality of vent hole sizes.

10. The lid of claim 1, further comprising a plurality of vent holes located at a plurality of proximities from said dispensing well, wherein at least one vent hole amongst said plurality of vent holes is blocked by said beverage when the drinking vessel is tipped from an upright position.

11. The lid of claim 1, wherein said lid is constructed from at least one of paper, plastic, thermoplastic resin, foam, a laminated material, a compostable resin, and a biodegradable material.

12. The lid of claim 1, wherein said lid is manufactured by one of thermoforming, injection molding, compression molding, vacuum forming, pressure forming, and hydro forming.

13. The lid of claim 1, wherein said lid is injection molded from a suitable grade of polypropylene resin.

14. The lid of claim 1, wherein said lid is injection molded from a plastic material.

15. The lid of claim 1, wherein said lid is disposable.

16. The lid of claim 1, wherein said beverage is a drinkable fluid that is one of tea, coffee, soup, shake, juice, and milk.

17. The lid of claim 1, wherein the at least one baffle surrounding said opening includes a pair of vertical walls extending from the well front wall to the spout front wall on each side of said opening.

18. The lid of claim 1, wherein a plurality of openings is provided in said well front wall of said dispensing well.

19. The lid of claim 1, wherein said at least one opening lies in a plane that is nearly vertical.

* * * * *